US006907875B1

(12) United States Patent
Eastman II et al.

(10) Patent No.: US 6,907,875 B1
(45) Date of Patent: Jun. 21, 2005

(54) OUTDOOR HEATER AND METHOD OF ASSEMBLING SAME

(76) Inventors: Robert Eastman II, c/o Game Tracker, Inc., P.O. Box 380, Flushing, MI (US) 48433; Jeffrey A. Pesture, c/o Game Tracker, Inc., P.O. Box 380, Flushing, MI (US) 48433

( * ) Notice: Subject to any disclaimer, the term of this patent is extended or adjusted under 35 U.S.C. 154(b) by 248 days.

(21) Appl. No.: 09/874,642

(22) Filed: Jun. 5, 2001

(51) Int. Cl.[7] ..... F24C 5/00
(52) U.S. Cl. ..... 126/92 B; 126/92 AC
(58) Field of Search ..... 126/92 B, 92 AC, 126/92 R, 248; 108/144.11, 147.22, 147.19

(56) References Cited

U.S. PATENT DOCUMENTS 3,174,443 A * 3/1965 Egger ..... 108/117
3,289,665 A * 12/1966 Loeb et al. ..... 126/92 B
3,738,286 A * 6/1973 Hoffman ..... 108/116
4,143,602 A * 3/1979 Brunn ..... 108/117
5,964,233 A * 10/1999 Clark et al. ..... 135/16
6,102,031 A * 8/2000 Waters ..... 126/92 AC
6,164,273 A * 12/2000 Waters ..... 126/92 AC
6,192,878 B1 * 2/2001 Waters ..... 126/92 AC
6,446,623 B1 * 9/2002 Resmo et al. ..... 126/92 R

* cited by examiner

*Primary Examiner*—Alfred Basichas
(74) *Attorney, Agent, or Firm*—Carrier, Blackman & Associates, P.C.; William D. Blackman; Joseph P. Carrier

(57) ABSTRACT

An outdoor heating apparatus, for warming the ambient air of a pre-selected area, includes a movable table attachment. The height-adjustable tabletop ergonomically enhances the surrounding area to accommodate the needs of various users, and an optional sectional heat transfer dome lowers shipping and packaging costs and reduces storage space. While the heating apparatus operates in a manner similar to that of traditional outdoor heaters, a fillable reservoir in the base member provides additional stability after the apparatus is assembled.

15 Claims, 6 Drawing Sheets

OUTDOOR HEATER AND METHOD OF ASSEMBLING SAME

BACKGROUND OF THE INVENTION

1. Field of the invention

The present invention relates to a heating apparatus for warming the ambient air within a selected area. More particularly, the present invention relates to an outdoor heating apparatus including a stabilizing base with an internal reservoir, a height-adjustable tabletop, and an optional multi-part heat transfer dome. The present invention also relates to a method of assembling a heating apparatus of the type described.

2. Description of the Background Art

Heating apparatus are widely used in commercial and residential settings. In particular, outdoor heating apparatus are used for warming the ambient air in designated outdoor areas. The general purpose of heaters of the above-described type is to provide a comfortable oudoor area, in which people may congregate. For example, a restaurant may designate an outdoor deck or patio for its smoking patrons, and during a cool night, such a heating apparatus would provide warmth to those outside.

Several variants of this general type of heating apparatus are illustrated in U.S. Pat. Nos. 5,964,233; 6,102,031; 6,164,273; and 6,192,878B1.

U.S. Pat. No. 5,964,233, issued to Clark et al., entitled, "Patio Umbrella with Radiant Heater," discloses a fuel-burning radiant heater secured below the umbrella canopy, to the patio umbrella pole. The Clark et al. invention uses a radiant heater in connection with a standard patio table and umbrella setup; thereby not requiring a base or a upper dome for heat transfer.

Traditional outdoor heating apparatus perform the task of warming ambient air within a predetermined space, as illustrated in U.S. Pat. No. 6,102,031, the disclosure of which is incorporated by reference herein.

U.S. Pat. Nos. 6,102,031; 6,164,273; and, 6,192,878B1, issued to Waters entitled, "Heating Apparatus," discloses an outdoor heating apparatus with a heat transfer dome smaller in diameter than that of a traditional outdoor heating apparatus, a heatradiating elongate pole, and heat-emitting assembly positioned slightly below the heat transfer dome. The Waters invention reduces the overall size of the heat transfer dome from the traditional 34½-inch diameter to a 30-inch diameter.

Heating apparatus of the above-described type, in general, are constructed with the majority of their components near the upper portion, placing a disproportionate amount of weight at the top of the heater. This weight distribution leads to some risk of the heater tipping over if bumped, which could have unwanted consequences.

As a result, a need still exists in the art for an outdoor heating apparatus which provides a more secure base to resist toppling, and which incorporates a height-adjustable tabletop, to ergonomically enhance the immediate surroundings.

SUMMARY OF THE INVENTION

The present invention has been developed to overcome the foregoing limitations and disadvantages of known heating apparatus, and to generally fulfill a need in the art for an outdoor heating apparatus which warms the ambient air within a selected area while alleviating the problems associated with the traditional outdoor heating apparatus.

In light of the disproportionate weight distribution of some of the previously known apparatus, a useful focus for improving outdoor heating apparatus is to develop a more secure base, to resist toppling, and to incorporate a tabletop for ergonomically enhancing the surrounding area.

An outdoor heating apparatus, in accordance with the present invention, includes a base member with a fillable reservoir for receiving liquid or solid material to increase stability of the apparatus on a substrate. An outdoor heating apparatus in accordance with the invention also has a hollow internal cavity formed therein for receiving and storing a fuel source, and a hollow conduit member for placement extending vertically upwardly from the base member, with an internal gas transfer line conducting fuel between the fuel source within base member and a fuel burner assembly. In a preferred embodiment of the invention, the heater apparatus includes a tabletop encircling the hollow conduit member with a releasable latch assembly for adjusting the height of the tabletop relative to the substrate.

An outdoor heating apparatus, in accordance with the present invention, also includes a fuel burner assembly for attachment at the upper end of the hollow conduit member; and a heat transfer dome for attachment adjacent the top of the fuel burner assembly.

Accordingly, it is an object of the present invention to provide an outdoor heating apparatus including a base member with greater stability. Through the incorporation of a fillable reservoir at the bottom of the base support, the base member is made substantially heavier, thereby improving the stability of the apparatus without compromising the size of the warming area or rate of heat production (as would occur if the base portion were enlarged or the upper portion reduced). A base member with a fillable reservoir is advantageous because it permits the user to input additional weight by filling the reservoir with material such as sand, water, or the like, to increase stability; yet, the additional weight may be removed for ease in transporting the apparatus. Additionally, the fillable reservoir permits the apparatus to be packaged and shipped in a manner and cost similar to, or less expensive than, that of traditional outdoor heating apparatus, while providing greater stability than the traditional outdoor heating apparatus.

Another object of the present invention to provide a base member having an internal cavity for concealably housing a fuel source. The internal cavity of the base member may house a fuel tank or a device for receiving a direct-line connection to an underground gas line (provided by a utility company). Additionally, having an internal cavity for concealing a fuel source aesthetically enhances as well as increases the viability of transporting the present invention.

Yet another object of the present invention is to incorporate an adjustable tabletop with the outdoor heating apparatus for more ergonomic use of the immediate surrounding area. Incorporating an adjustable tabletop into the outdoor heating apparatus is more advantageous than a fixed table top, since the tabletop may either be raised to accommodate a group of people as they stand around the apparatus, or lowered to accommodate a group of people as they sit around the apparatus. For example, the table may be used as an eating surface or as an area where people store miscellaneous items, etc.

Still another object of the present invention is to optionally provide a heat transfer dome having a concavo-convex shape. The concavo-convex shape effectively redirects the heat generated by the fuel burner as compared to other designs. The heat transfer dome may be constructed from a unitary piece of material or through the assembly of a plurality of interconnectable individual segments, whereby the segments may be dissembled and placed into a compact configuration for shipping, packaging, or storage.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENT

Figure 1:
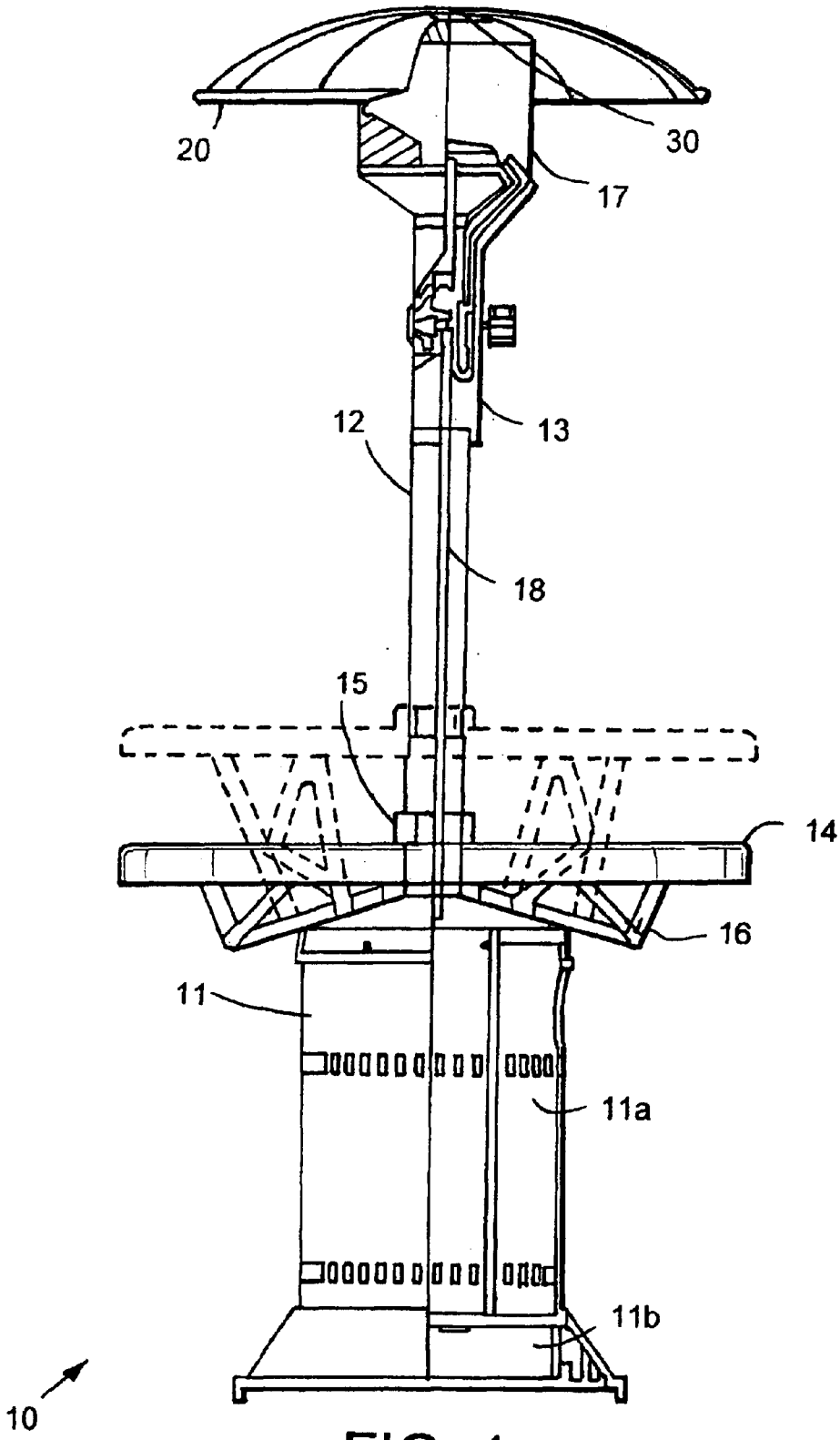
FIG. 1 is a cut-away, perspective view of an outdoor heating apparatus in accordance with the preferred embodiment of the invention, elevated tabletop shown in phantom.

Referring now to FIG. 1 of the drawings, an outdoor heating apparatus, in accordance with a first embodiment of the invention, is shown generally at 10. The heating apparatus 10 includes a support base 11 having an internal cavity 11*a* for holding a fuel source (not shown). The support base 11 also includes a fillable reservoir 11*b* for containing an additional weight source (e.g. water, sand, or the like) and may be constructed from any rigid material, such as steel, aluminum, plastic, or the like.

Fixably secured to the support base 11 and extending upward therefrom is an hollow conduit member 12, constructed from a ridged material in kind to those for construction of the support base, having an internal gas transfer line 18 for fuel transfer and further including a fuel control/igniting assembly 13. Adjustably secured to the hollow conduit member 12 between the fuel control/igniting assembly 13 and the support base 11 is a height-adjustable tabletop 14. The height-adjustable tabletop 14 includes a releasably locking device 15 for engagement with the hollow conduit member 12 and adjustably movable brackets 16 for supporting the outer perimeter. Positioned above the tabletop 14 and the fuel control/igniting assembly 13, attached to the uppermost section of the hollow conduit member 12 is the fuel burner assembly 17 which emits heat to be downwardly reflected by the heat transfer dome 20, secured to the top of the fuel burner assembly 17. The heat transfer dome 20 is concavo-convex in shape, to minimize heat loss therefrom and may be constructed from a metallic or composite material suitable for conducting and radiating heat.

Figure 2:
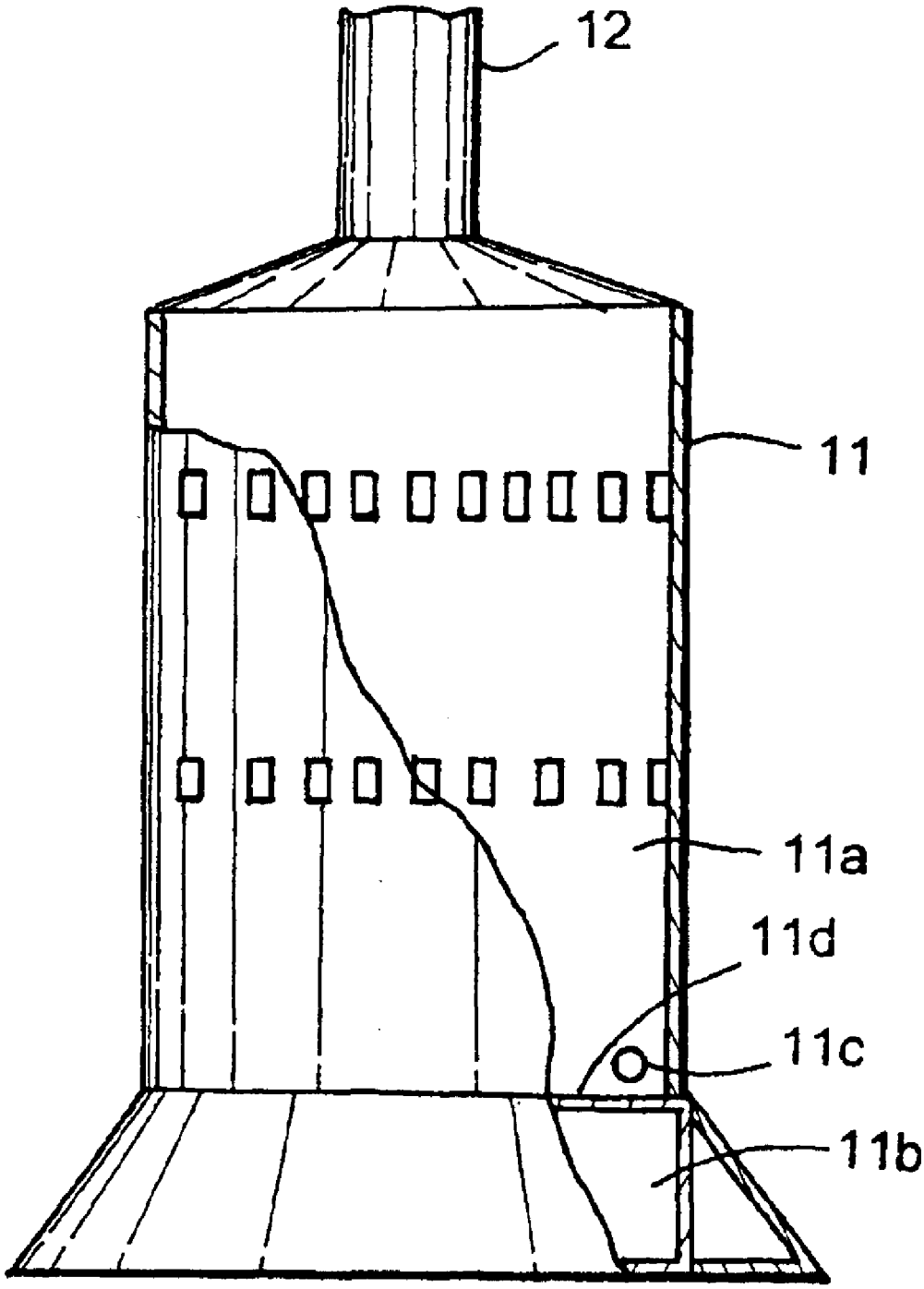
FIG. 2 is a cut-away front view of the support base.

FIG. 2 illustrates the internal areas of the support base. The support base 11 includes an internal cavity 11*a* for receiving a fuel source (not shown). The fuel source for the heating apparatus is either a conventional fuel tank, such as a propane tank, or a direct-line connection to an underground gas line, provided by a utility company.

The support base 11 further includes an access panel (not shown) for placement or replacement of the fuel source within the internal cavity 11*a*, such that the fuel source is completely concealed when the access panel (not shown) is closed. Alternatively, the support base 11 may include an upper and lower section to accomplish the same end as the access panel.

Additionally, the support base 11, in the case of a direct-line connection the underground gas line (not shown), incorporates a portal 11*c* located in the lower portion of the side wall of the base member 11 for inserting a fuel line. The support base 11 also includes a fillable reservoir 11*b* within the lower most area of the base member 11. The fillable reservoir 11*b* may be filled with liquid or solid material by the user to increase the weight of the base member 11, thereby enhancing its stabilizing quality.

Optionally, the apparatus 10 may include a stabilizer bottle 32 which fits inside of the reservoir 11*b*, for holding a solid or liquid material more discretely therein. The stabilizer bottle 32 is preferably made of a strong, sturdy plastic such as polyethylene or polypropylene. Where the stabilizer bottle 32 is used, an opening may be formed in the base member 11, or a part of the base member 11 may be made removable to allow placement of the stabilizer bottle 32 thererin.

Figure 5:
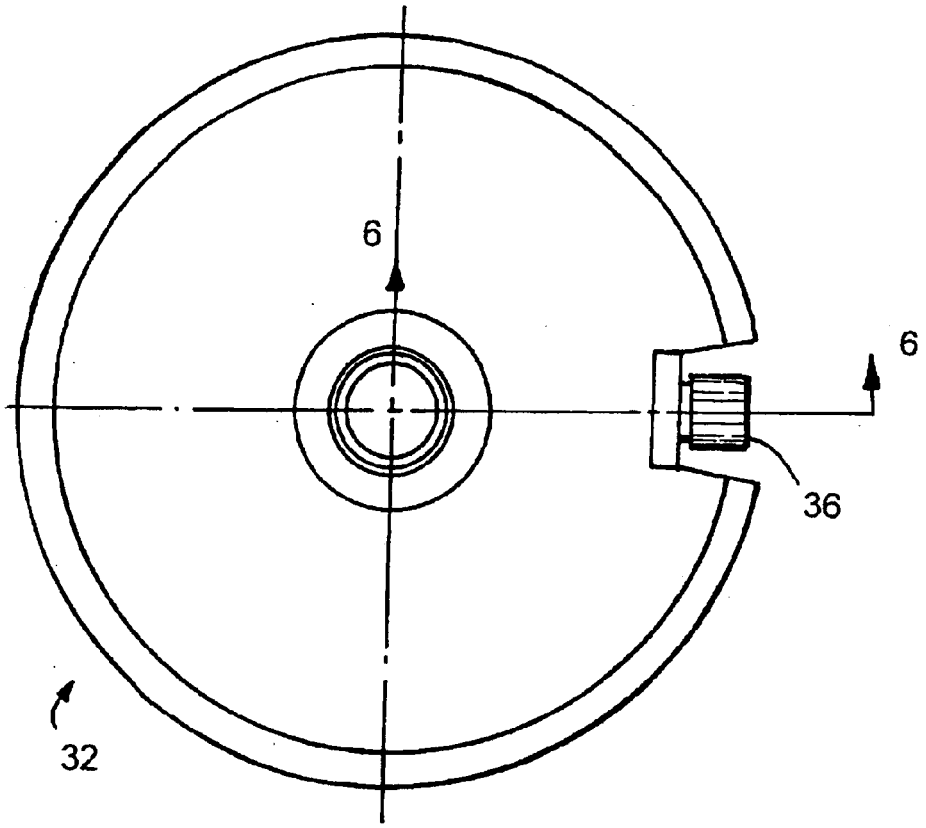
FIG. 5 is a top plan view of an optional stabilizer bottle which may be used in connection with the apparatus hereof.
Figure 6:
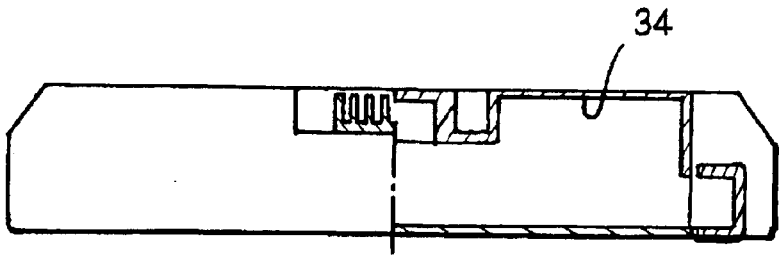
FIG. 6 is a side plan view of the bottle of FIG. 5, partially in cross-section taken along the line 6—6 in FIG. 5.

As shown in FIGS. 5–6, the stabilizer bottle 32 defines a hollow storage cavity 34 therein for holding sand, gravel, or a liquid such as an antifreeze solution therein. An antitifreeze solution is a preferred liquid because when used in cold climates, the antifreeze prevents rupturing of the reservoir 11*b* which could otherwize occur if water froze therein. The stabilizer bottle 32 also includes a removable cap 36 to allow filling of the hollow storage cavity 34.

Figure 3:
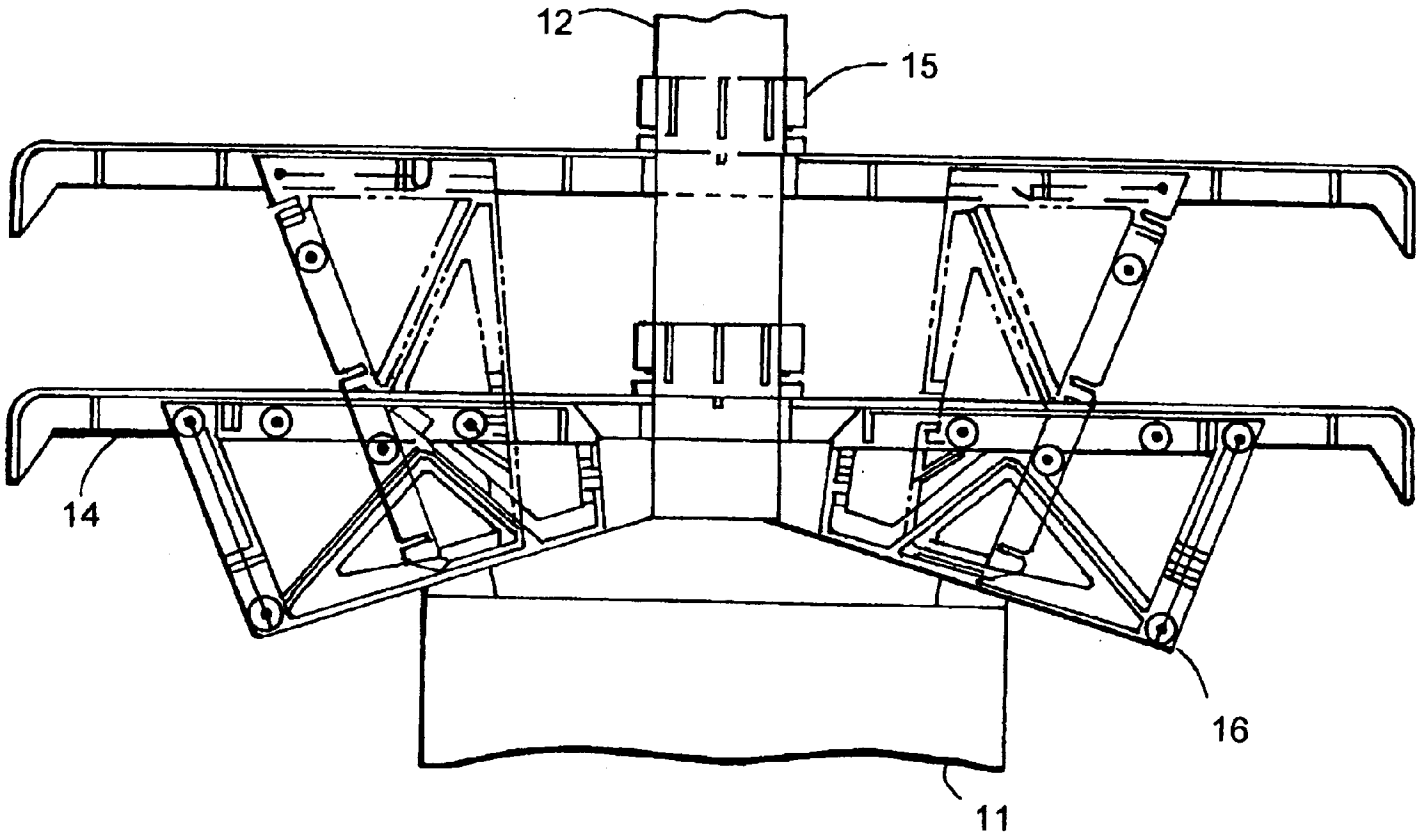
FIG. 3 is a front view of the tabletop at differing heights.

As noted, the heating apparatus 10 according to the invention may include a table top 14. Most preferably, the tabletop 14 is made adjustable so that it may be moved into at least two different height settings. Referring to FIG. 3, the tabletop 14 is shown in a low position in solid lines, and is also shown in an elevated position in phantom. The tabletop 14 is slidably secured to the hollow conduit member 12, above the support base 11. The tabletop 14 may include a releasable locking latch assembly 15 which enables the tabletop 14 to be releasably secured at selected heights along the hollow conduit member 12, between the support base 11 and the fuel control ignition/control assembly 13.

In the depicted embodiment, the tabletop further includes adjustably movable brackets 16 for supporting the tabletop 14. Alternatively, the adjustable tabletop may only include one to the aforementioned devices, or may utilize a different adjustment means altogether, such as a toothed or ratcheting mechanism.

Figure 4:
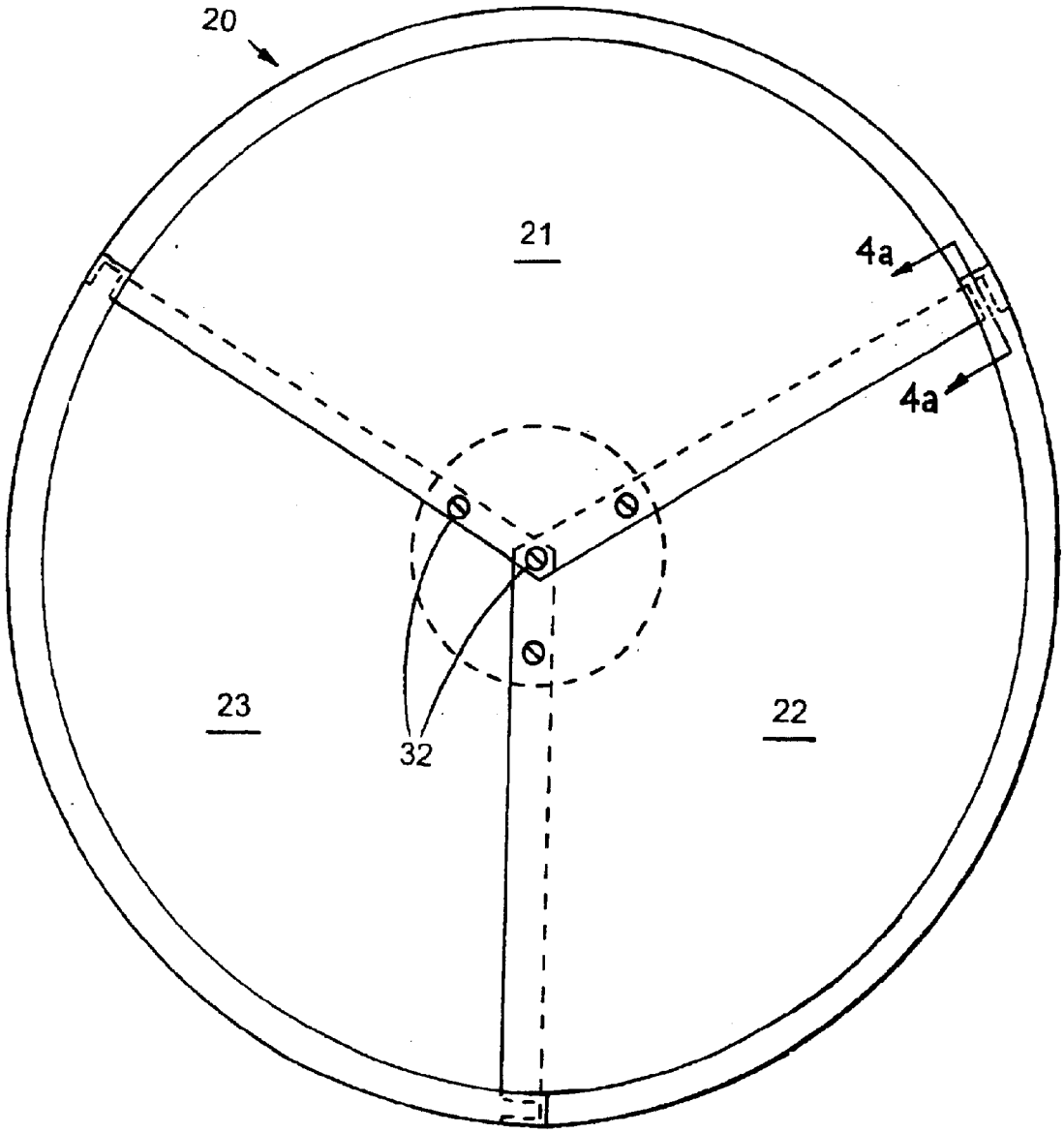
FIG. 4 is a top view of the sectional heat transfer dome as assembled in accordance with the preferred embodiment of the invention.

Referring to FIG. 4, according to the preferred embodiment of the invention, the heat transfer dome may be constructed from a unitary piece of material, shown at 20. Alternatively, the heat transfer dome may be constructed through the assembly of a plurality of segments, shown at 21, 22, and 23. Either as a single unit or as an assembly of interconnected segments the heat transfer dome 20 is concavo-convex, which efficiently conducts heat in a uniform manner over the entire surface area and reflects warm air downwardly, at an angle, to the desired heating area; however, the heat transfer dome may be shaped in an alternative manner, so long as the selected shape is suitable for conducting, radiating, and directing warm air downwardly, at an angle, direction to a designated area.

As shown in FIG. 4, one method of attaching the heat transfer dome 20 to the fuel burner assembly 17 is through contact with a mounting bracket 30. Where the mounting bracket 30 is used, the heat transfer dome 20 is removably secured to the mounting bracket 30 by inserting and tightening conventional heat-tempered screws (not shown) through pre-drilled holes 26 of the of the heat transfer dome 20; however, the mounting bracket 30 may alternatively include a single vertically extending shaft or a plurality of vertically extending shafts, rather than the threaded holes (not shown).

As an alternative to the preferred means of attaching the heat transfer dome 20 without the use of the mounting bracket 30, the heating apparatus 10 may include the construction of substantially "L" shaped bracket arms which outwardly and upwardly extend from the burner assembly 17 and removably secure the sectional heat transfer dome 20 to the burner assembly 17 through engagement of the sectional heat transfer dome 20 at two, three, or four, predetermined areas.

Alternatively, the heat transfer dome may be constructed through the use and assembly of individual segments 21, 22, and 23. Once the segments 21, 22, and 23 are placed into their aligned configuration, each of the segments 21, 22, and 23 attaches to the fuel burner assembly 17 similar to that of a heat transfer dome of unitary construction. One suitable manner of interlocking the individual segments with one another is illustrated in FIG. 4*a*.

Figure 4A:
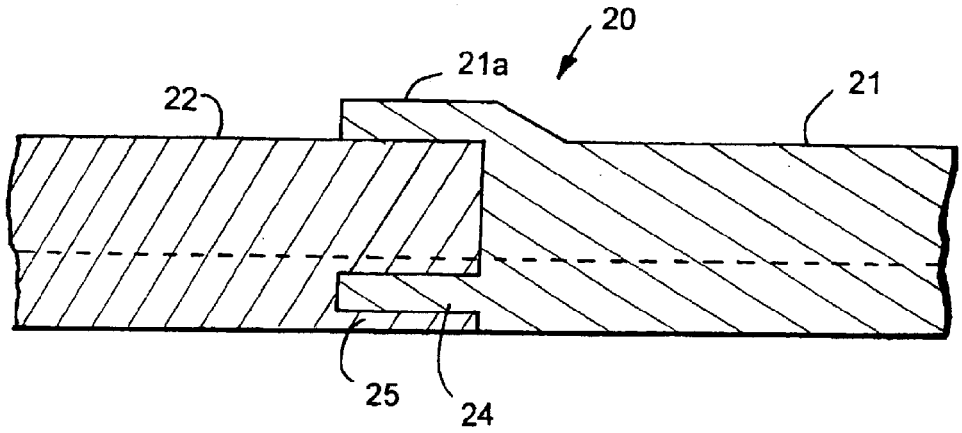
FIG. 4*a* is a cross-sectional view of one possible structure for interlocking heat transfer dome segments.

Referring to FIG. 4*a*, which provides a cross-sectional view of the aforementioned method with which the segments 21, 22, and 23 interlock, the upward extending flange 21 a of segment 21 accommodates a portion of opposing segment 22, which is necessary in order that the two segments overlap for purposes of aligning the predrilled holes 26. Additionally, FIG. 4*a* illustrates the engagement between the protruding member 24 located at the outermost area of segment 21 with the receiving member 25 of segment 22 for joining the perimeter of each segment 21, 22, and 23. As an alternative, the sectional heat transfer dome may be interlocked through a tongue and groove system or through a saw-tooth configuration.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

What is claimed is:

1. An outdoor heating apparatus, comprising:

a base member having a hollow internal cavity;

a hollow conduit extending vertically upwardly from the base member;

a tabletop movably mounted to the hollow conduit between the base member and the fuel burner assembly, said tabletop being slidably vertically adjustable on said conduit;

a fuel burner assembly attached to the upper end of said hollow conduit, and;

a heat transfer dome having a closed central portion and an outer edge spaced away from said central portion, said heat transfer dome being operatively attached to an upper end of said hollow conduit;

wherein the tabletop has a plurality of movable supports attached to the underside thereof for spacing the tabletop upwardly from the base member, wherein said movable supports are situated between the base member and the tabletop.

2. The heating apparatus of claim 1, wherein the base member has hollow fillable reservoir formed therein below the internal cavity and separated therefrom by a partition, and wherein said reservoir is adapted to removably store liquid material.

3. The heating apparatus of claim 1, wherein the base member has a hollow fillable reservoir formed therein below the internal cavity and separated therefrom by a partition, and wherein said reservoir is adapted to removably store solid material.

4. The heating apparatus of claim 1, wherein the tabletop supports are arrangable in a first orientation for supporting the table at a first height above the base, and are also arrangable in a second orientation for supporting the table at a second height above the base.

5. An outdoor heating apparatus, comprising:

a base member having a hollow internal cavity;

a hollow conduit extending vertically upwardly from the base member;

a tabletop movably mounted to the hollow conduit between the base member and the fuel burner assembly, said tabletop being slidably vertically adjustable on said conduit;

a fuel burner assembly attached to the upper end of said hollow conduit, and;

a heat transfer dome having a closed central portion and an outer edge spaced away from said central portion, said heat transfer dome being operatively attached to an upper end of said hollow conduit;

wherein the heat transfer dome comprises a plurality of individual segments, each of said segments extending substantially uninterruptedly from said closed central portion out to an outer edge of said dome.

6. The heat transfer dome of claim 5, wherein each of the segments interconnects to two adjacent segments to form said heat transfer dome.

7. An outdoor heating apparatus, comprising:

a base member having a hollow internal cavity formed therein and having a hollow fillable reservoir formed therein which is separate from and situated below the internal cavity, the base member comprising a substantially horizontal partition which separates the internal cavity thereof from the reservoir;

a hollow conduit extending vertically upwardly from the base member;

a fuel burner assembly attached to the upper end of said hollow conduit, and;

a heat transfer dome operatively attached to said fuel burner assembly, to said conduit, or to said fuel burner assembly and said conduit.

8. The heating apparatus of claim 7, wherein the fillable reservoir of the base member is adapted to removably store liquid material therein.

9. The heating apparatus of claim 7, wherein the fillable reservoir of the base member is adapted to removably store solid material therein.

10. The heating apparatus of claim 7, further comprising a stabilizer bottle which fits removably into the reservoir.

11. The heating apparatus of claim 7, wherein the heat transfer dome comprises a plurality of individual segments, each of said segments extending substantially uninterruptedly from said closed central portion out to an outer edge of said dome.

12. The heating apparatus of claim 7, further comprising a table top operatively attached to and substantially surrounding the hollow conduit.

13. The heating apparatus of claim 12, wherein the table top is vertically adjustably movable in relation to the hollow conduit.

14. An outdoor heating apparatus, comprising:

a base member having a hollow internal cavity;

a hollow conduit extending vertically upwardly from the base member;

a tabletop movably mounted to the hollow conduit between the base member and the fuel burner assembly, said tabletop being slidably vertically adjustable on said conduit between at least two positions thereof, said tabletop including a releasably locking device for engagement with the conduit member;

a fuel burner assembly attached to the upper end of said hollow conduit, and;

a heat transfer dome operatively attached to an upper end of said hollow conduit, said heat transfer dome having a concavo-convex shape including a closed central portion, said heat transfer dome comprising a plurality of substantially rigid individual segments, each of said segments extending substantially uninterruptedly from said closed central portion out to an outer edge of said dome.

15. An outdoor heating apparatus, comprising:

a base member having a hollow internal cavity;

a hollow conduit extending vertically upwardly from the base member;

a tabletop movably mounted to the hollow conduit between the base member and the fuel burner assembly, said tabletop being slidably vertically adjustable on said conduit;

a plurality of movable supports operatively attached to the underside of said tabletop for spacing the tabletop upwardly from the base member, wherein said movable supports rest on the base member during use;

a fuel burner assembly attached to the upper end of said hollow conduit, and;

a heat transfer dome operatively attached to an upper end of said hollow conduit.

* * * * *